US009719355B2

(12) United States Patent
Chouhan et al.

(10) Patent No.: US 9,719,355 B2
(45) Date of Patent: Aug. 1, 2017

(54) ROTARY MACHINE BLADE HAVING AN ASYMMETRIC PART-SPAN SHROUD AND METHOD OF MAKING SAME

(71) Applicant: General Electric Company, Schenectady, NY (US)

(72) Inventors: Rohit Chouhan, Karnataka (IN); Sumeet Soni, Karnataka (IN)

(73) Assignee: General Electric Company, Schenectady, NY (US)

( * ) Notice: Subject to any disclaimer, the term of this patent is extended or adjusted under 35 U.S.C. 154(b) by 697 days.

(21) Appl. No.: 14/135,884

(22) Filed: Dec. 20, 2013

(65) Prior Publication Data

US 2015/0176411 A1 Jun. 25, 2015

(51) Int. Cl.
*F01D 5/14* (2006.01)
*F01D 5/22* (2006.01)

(52) U.S. Cl.
CPC ..... *F01D 5/14* (2013.01); *F01D 5/225* (2013.01); *Y10T 29/49336* (2015.01)

(58) Field of Classification Search
CPC ... F01D 5/22; F01D 5/225; F01D 5/14; F01D 5/141; F01D 5/16; F01D 11/008; F01D 25/06; F04D 29/326; F05D 2240/305; F05D 2240/306
See application file for complete search history.

(56) References Cited

U.S. PATENT DOCUMENTS 3,719,432 A * 3/1973 Musick et al. ..... F01D 5/22 416/190
5,695,323 A 12/1997 Pfeifer et al.
6,341,941 B1 * 1/2002 Namura ..... F01D 5/16 416/190
8,540,488 B2 * 9/2013 Marra ..... F01D 5/22 416/190

(Continued)

FOREIGN PATENT DOCUMENTS

DE 2711409 A1 8/1978
GB 948264 A * 1/1964 ..... F01D 5/22

OTHER PUBLICATIONS

U.S. Appl. No. 13/717,265, filed Dec. 19, 2012 entitled Tapered Part-Span Shroud.

*Primary Examiner* — Craig Kim
*Assistant Examiner* — Julian Getachew
(74) *Attorney, Agent, or Firm* — Armstrong Teasdale LLP

(57) ABSTRACT

A method of manufacturing a blade for use with a rotary machine includes coupling a suction-side section of a part-span shroud to a suction-side surface of an airfoil of the blade. A first point of the airfoil suction-side surface, defined where a trailing edge of the suction-side section intersects the airfoil suction-side surface, is upstream from a second point, defined where a throat intersects the airfoil suction-side surface. A third point, defined where a leading edge of the suction-side section intersects the airfoil suction-side surface, is downstream from a fourth point, defined at a (Continued)

leading edge of the blade. The method also includes coupling a pressure-side section of the part-span shroud to a pressure-side surface of the airfoil. A fifth point of the airfoil pressure-side surface, defined where a trailing edge of the pressure-side section intersects the airfoil pressure-side surface, is downstream from the first point.

20 Claims, 7 Drawing Sheets

(56) References Cited

U.S. PATENT DOCUMENTS

| | | | |
|---|---|---|---|
| 2010/0092295 | A1 | 4/2010 | Riaz et al. |
| 2010/0247315 | A1 | 9/2010 | DeMania et al. |
| 2011/0158810 | A1 | 6/2011 | Shibukawa et al. |

* cited by examiner

ROTARY MACHINE BLADE HAVING AN ASYMMETRIC PART-SPAN SHROUD AND METHOD OF MAKING SAME

BACKGROUND

The field of the disclosure relates generally to a blade or bucket for use in a rotary machine, and more particularly to a part-span shroud for stabilizing such blades.

At least some known rotary machines, such as steam turbines or gas turbines, include a fluid flow path generally defined between a stationary component and a rotating component. Such known rotary machines may include stationary vanes and rotating blades arranged in alternating rows so that a row of vanes and an immediately downstream row of blades cooperate to form a "stage." Each stage may include a number of stationary vanes coupled to the stationary component in a circumferential array, extending radially inward into the fluid flow path, and a number of rotating blades coupled to the rotating component in a circumferential array and extending radially outward into the fluid flow path. The vanes are oriented to direct fluid flow at a desired angle into a row of blades immediately downstream. Known blades include airfoils that extract energy from the fluid, thereby developing the power necessary to drive the rotating component and an attached load, for example, an electrical generator or a pump.

In at least some known rotary machines, the rotational speed of the rotating component may induce an undesirable amount of vibration and/or axial torsion into low-pressure stages of the rotary machine, for example. To limit such vibration and/or axial torsion, at least some known blades include part-span shrouds extending from the airfoils at an intermediate radial distance between a tip and a root section of each blade. The part-span shrouds are typically coupled to each of the pressure (concave) and suction (convex) sides of each blade airfoil, such that during operation of the rotary machine, circumferentially adjacent part-span shrouds on adjacent blades contact each other during rotation of the rotating component.

Typically, part-span shrouds are coupled to the suction side of each blade and to the pressure side of each adjacent blade such that the leading and trailing edges of the part-span shrouds are substantially parallel to the direction of rotation of the blades. In other words, if adjacent blades are viewed along a radial direction, from above the blade tips and toward the blade roots, the part-span shroud leading edges all lie approximately on a straight line, and the part-span shroud trailing edges all lie approximately on a straight line. In such an orientation, a trailing edge portion of such symmetric part-span shrouds may extend at least partially within the throat of the flow path between adjacent blades. That is, the shrouds may extend into the location of minimal cross-sectional flow path area between adjacent blades and cause a loss of efficiency in the extraction of work from the fluid. In addition, because it would be undesirable to extend the part-span shrouds further into the throat area, such aligned part-span shrouds can provide relatively little structural support to the trailing edges of each blade.

At least some known blades have attempted to overcome these drawbacks by coupling the part-span shroud such that its leading edge extends from the leading edge of the suction side of the blade to an intermediate location along a chord of the pressure side of the adjacent blade. In such an orientation, the part-span shrouds are not aligned in the direction of rotation. This orientation facilitates moving the trailing edge of the part-span shrouds from the throat area, while providing support to the trailing edge of the blade. However, locating the leading edge of the part-span shroud at the leading edge of the suction side of the blade may produce an undesirable degree of obstruction of the flow at the blade leading edge, resulting in a decreased efficiency.

BRIEF DESCRIPTION

In one aspect, a method of manufacturing a blade having a part-span shroud for use with a rotary machine is provided. The method includes coupling a suction-side section of the part-span shroud to a suction-side surface of an airfoil of the blade. The suction-side section is positioned such that a first point of the airfoil suction-side surface, defined where a trailing edge of the suction-side section intersects the airfoil suction-side surface, is upstream from a second point of the airfoil suction-side surface, defined where a throat intersects the airfoil suction-side surface when the rotary machine is in operation. The suction side is further positioned such that a third point of the airfoil suction-side surface, defined where a leading edge of the suction-side section intersects the airfoil suction-side surface, is downstream from a fourth point of the airfoil suction-side surface, defined at a leading edge of the blade. The method also includes coupling a pressure-side section of the part-span shroud to a pressure-side surface of the airfoil. The pressure-side section is positioned such that a fifth point of the airfoil pressure-side surface, defined where a trailing edge of the pressure-side section intersects the airfoil pressure-side surface, is downstream from the first point.

In another aspect, a blade for use with a rotary machine is provided. The blade includes an airfoil having a pressure-side surface and an opposite suction-side surface. The blade also includes a suction-side section of a part-span shroud coupled to the airfoil suction-side surface. A first point of the airfoil suction-side surface, defined where a trailing edge of the suction-side section intersects the airfoil suction-side surface, is upstream from a second point of the airfoil suction-side surface, defined where a throat intersects the airfoil suction-side surface when the rotary machine is in operation. In addition, a third point of the airfoil suction-side surface, defined where a leading edge of the suction-side section intersects the airfoil suction-side surface, is downstream from a fourth point on the airfoil suction-side surface, defined at a leading edge of the blade. The blade further includes a pressure-side section of the part-span shroud coupled to the airfoil pressure-side surface. A fifth point of the airfoil pressure-side surface, defined where a trailing edge of the pressure-side section intersects the airfoil pressure-side surface, is downstream from the first point.

In yet another aspect, a rotary machine is provided. The rotary machine includes at least one rotor wheel coupled to a shaft, and a plurality of blades coupled to the at least one rotor wheel. Each of the blades includes an airfoil having a pressure-side surface and an opposite suction-side surface. Each blade also includes a suction-side section of a part-span shroud coupled to the airfoil suction-side surface. A first point of the airfoil suction-side surface, defined where a trailing edge of the suction-side section intersects the airfoil suction-side surface, is upstream from a second point of the airfoil suction-side surface, defined where a throat intersects the airfoil suction-side surface when the rotary machine is in operation. In addition, a third point of the airfoil suction-side surface, defined where a leading edge of the suction-side section intersects the airfoil suction-side surface, is downstream from a fourth point on the airfoil suction-side surface, defined at a leading edge of the blade. Each blade further includes a pressure-side section of the part-span shroud coupled to the airfoil pressure-side surface. A fifth point of the airfoil pressure-side surface, defined where a trailing edge of the pressure-side section intersects the airfoil pressure-side surface, is downstream from the first point.

DETAILED DESCRIPTION

The exemplary methods and systems described herein overcome at least some of the disadvantages associated with known part-span shrouds. The embodiments described herein shift the trailing edge of the part-span shroud from the throat area and provide more support to the trailing edge of the blade, while decreasing the flow obstruction at the blade leading edge. More specifically, contrary to known rotary blades, embodiments of the part-span shroud described herein locate the leading edge of the part-span shroud downstream from the leading edge of the suction side of the blade.

Figure 1:
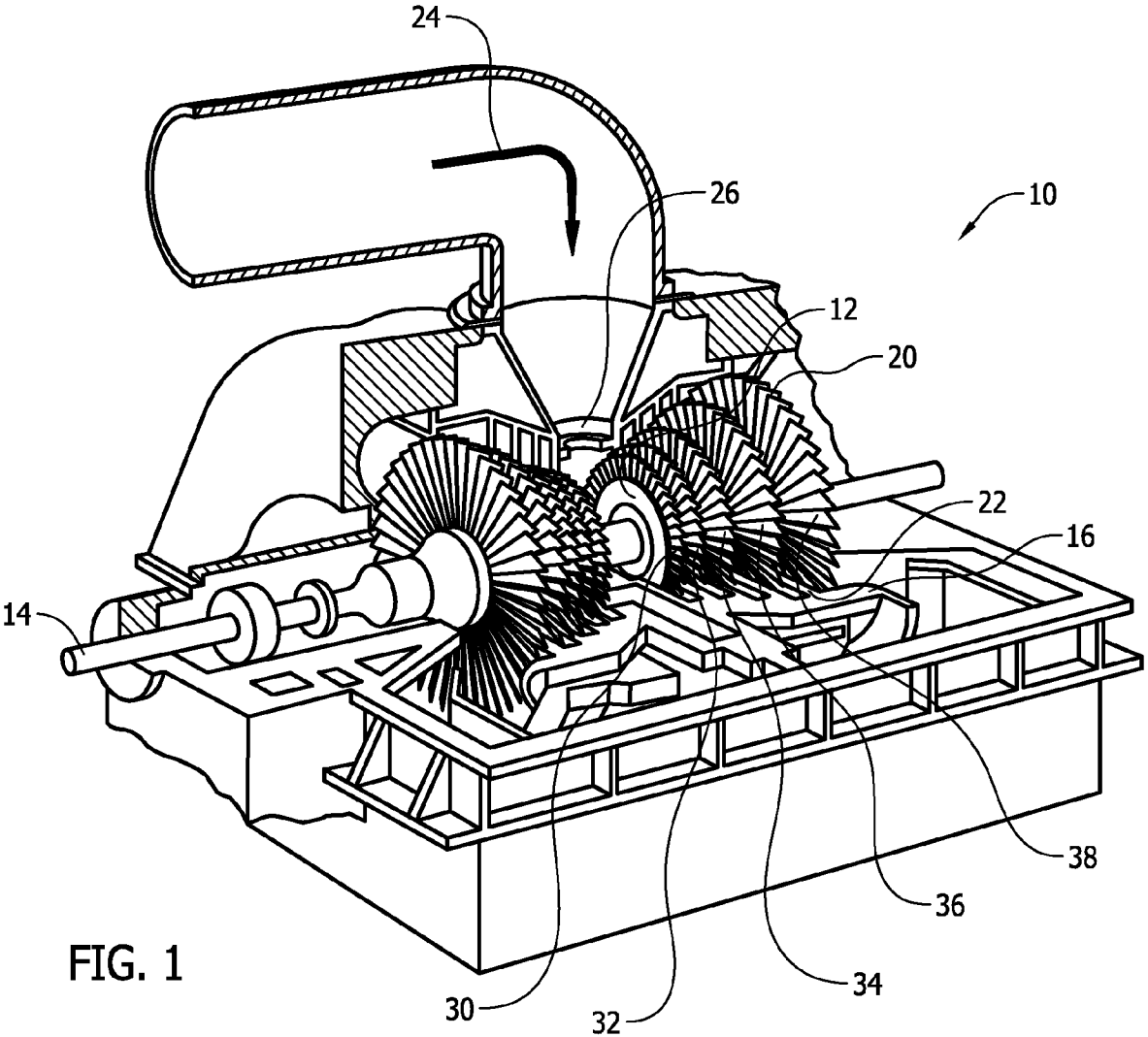
FIG. 1 is a perspective partial cut-away view of an exemplary steam turbine.
Figure 2:
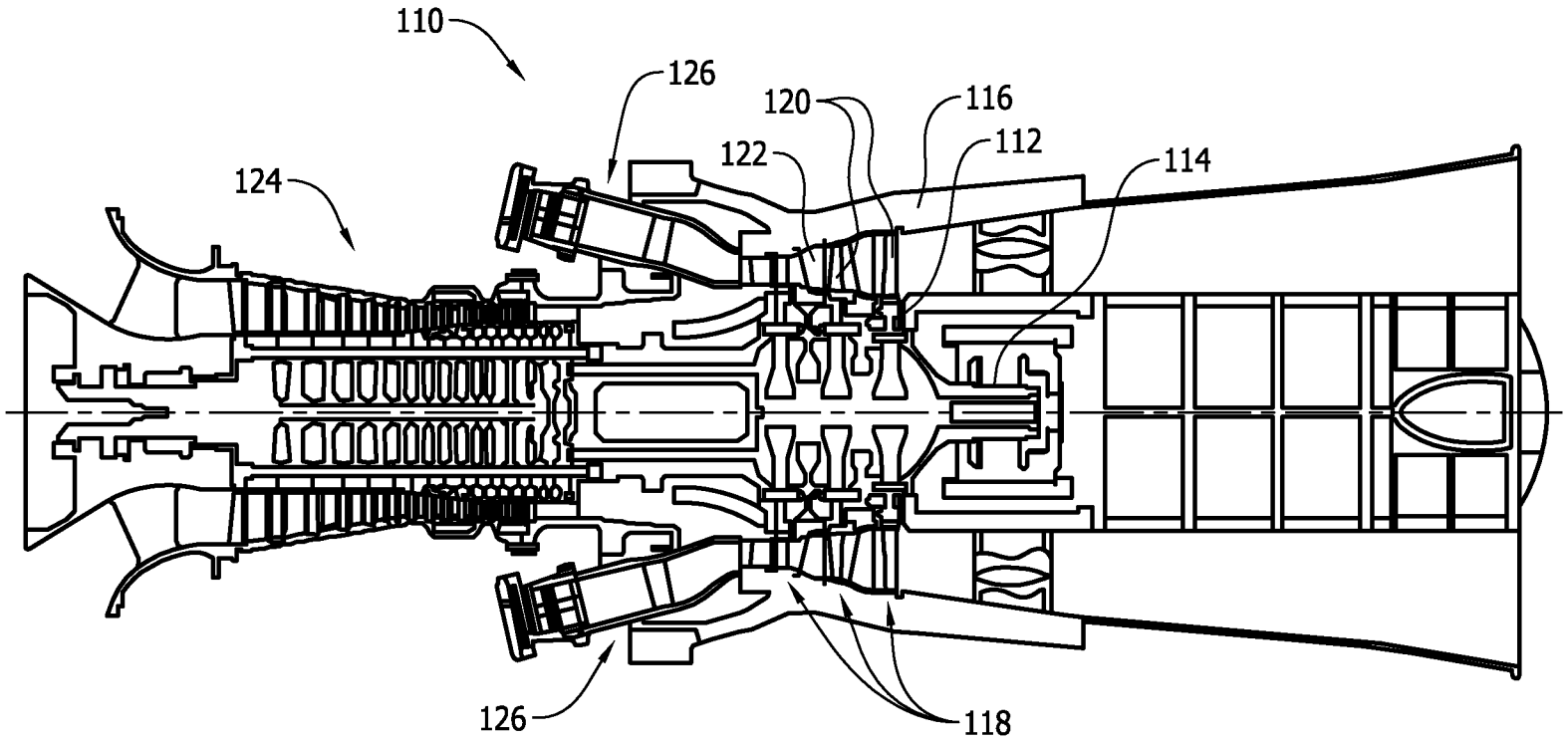
FIG. 2 is a cross-sectional schematic view of an exemplary gas turbine.

FIG. 1 and FIG. 2 represent two exemplary rotary machine environments for which embodiments of the part-span shroud of the current invention may be suited. FIG. 1 is a perspective partial cut-away view of an exemplary steam turbine 10.

Steam turbine 10 includes a plurality of axially spaced rotor wheels 12 coupled to a rotatable shaft 14. A plurality of blades 20 are mechanically coupled to, and extend radially outwardly from, each rotor wheel 12. More specifically, blades 20 are arranged in rows that extend circumferentially around each rotor wheel 12. A plurality of stationary vanes 22 extend radially inwardly from a casing 16, circumferentially around shaft 14. More specifically, a row of stationary vanes 22 is axially positioned upstream of each row of blades 20. Each row of stationary vanes 22 cooperates with a row of rotatable blades 20 to form one of a plurality of turbine stages, and to define a portion of a steam flow path through steam turbine 10.

In the embodiment shown in FIG. 1, steam turbine 10 includes five stages 30, 32, 34, 36 and 38. Stage 30 is the first stage and is the smallest (in a radial direction) of the five stages. Stage 32 is the second stage and is the next stage in an axial direction. Stage 34 is the third stage and is shown in the middle of the five stages. Stage 36 is the fourth and next-to-last stage. Stage 38 is the last stage and is the largest (in a radial direction). It should be understood that more or fewer than five stages may be present in alternative embodiments.

During operation, high-pressure and high-temperature steam 24 is channeled from a steam source, such as a boiler or the like (not shown), through an inlet 26. From inlet 26, steam 24 is channeled downstream through casing 16, where it encounters turbine stages 30, 32, 34, 36 and 38. As the steam impacts the plurality of blades 20 in each stage, it induces rotation of shaft 14. Thus, thermal energy of steam 24 is converted to mechanical rotational energy. Steam 24 exits casing 16 at an exhaust (not shown). Shaft 14 may be attached to a load or machinery (not shown) such as, but not limited to, a generator, and/or another turbine. In some embodiments, steam turbine 10 is one of several turbines that are all co-axially coupled to the same shaft 14. Steam turbine 10 may, for example, be one of a high pressure turbine, an intermediate pressure turbine, and a low pressure turbine that are coupled together.

A cross-sectional schematic illustration of a gas turbine 110 is shown in FIG. 2. Gas turbine 110 includes a plurality of axially spaced rotor wheels 112 coupled to a shaft 114. A plurality of blades 120 are mechanically coupled to, and extend radially from, each rotor wheel 112. More specifically, blades 120 are arranged in rows that extend circumferentially around each rotor wheel 112. A plurality of stationary vanes 122 extend radially inwardly from a casing 116, circumferentially around shaft 114. More specifically, a row of stationary vanes 122 is axially positioned upstream of each row of blades 120. Each row of stationary vanes 122 cooperates with a row of rotatable blades 120 to form one of a plurality of turbine stages 118, and to define a portion of a gas flow path through gas turbine 110.

During operation, air at atmospheric pressure is compressed by a compressor 124 and delivered to one or more combustors 126. In each combustor 126, the air leaving the compressor is heated by adding fuel to the air and burning the resulting air/fuel mixture. The gas flow resulting from combustion of fuel is channeled downstream through casing 116, where it encounters the plurality of turbine stages 118. As the gas impacts the plurality of blades 120 in each stage, it induces rotation of shaft 114, thus producing mechanical rotational energy. Shaft 114 may be attached to a load or machinery.

Figure 3:
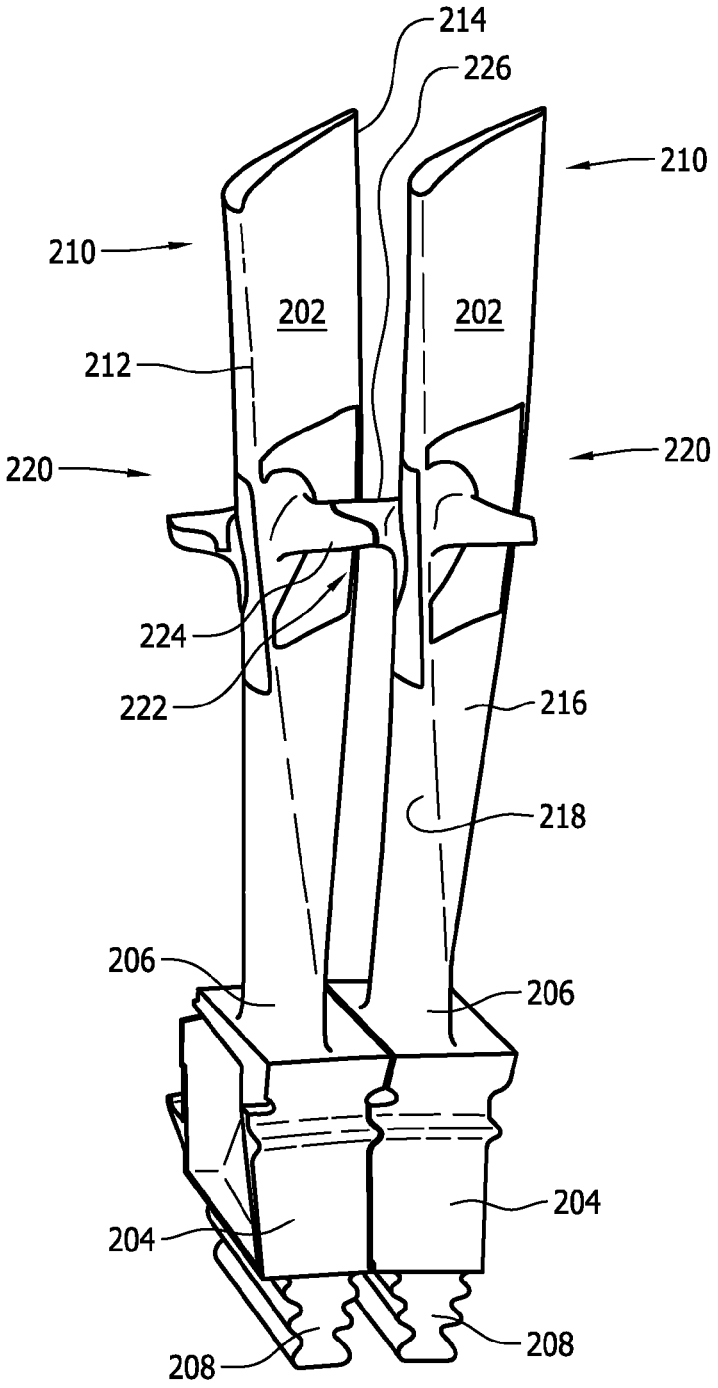
FIG. 3 is a perspective view of an embodiment of a pair of blades for use with the exemplary steam turbine of FIG. 1 or the exemplary gas turbine of FIG. 2.

A perspective view of an embodiment of a pair of blades 220 is shown in FIG. 3. Blades 220 may be either blades 20 or blades 120, and the following description is applicable equally to blades 20 and blades 120. Each blade 220 includes an airfoil 202, and a root 204 affixed to a first end 206 of airfoil 202. When assembled to a rotor wheel, such as rotor wheel 12 shown in FIG. 1 or rotor wheel 112 shown in FIG. 2, root 204 is disposed at a radially inward end of airfoil 202. A blade attachment member 208 projects from root 204. In some embodiments, blade attachment member 208 is a dovetail, but alternative embodiments may include other blade attachment member shapes and configurations known in the art. A tip portion 210 of airfoil 202 is located opposite first end 206. When assembled to a rotor wheel, such as rotor wheel 12 shown in FIG. 1 or rotor wheel 112 shown in FIG. 2, tip portion 210 is disposed at a radially outward end of blade 220. Each blade 220 also has a leading edge 212, a trailing edge 214, a generally concave pressure side 216, and a generally convex suction side 218.

A part-span shroud 222 is disposed between blades 220 at an intermediate location along the span of each airfoil 202 between first end 206 and tip portion 210. In some embodiments, part-span shroud 222 has an airfoil shape, with a leading edge 224 and a trailing edge 226. One or both of a cross-sectional shape and a cross-sectional area of part-span shroud 222 may vary at different locations along part-span shroud 222 between adjacent blades 220.

Figure 4:
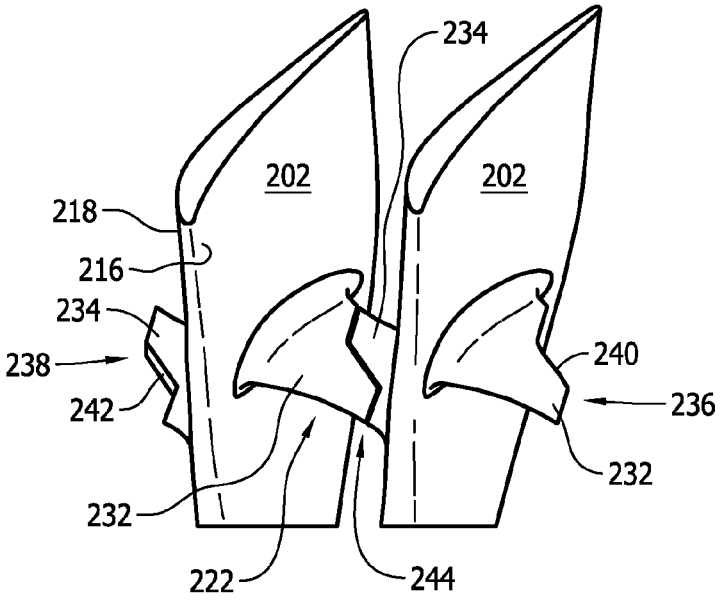
FIG. 4 is perspective view of an embodiment of a part-span shroud that may be included on the blades shown in FIG. 3.

A perspective view of an embodiment of part-span shroud 222 is shown in FIG. 4. In the embodiment of FIG. 4, each part-span shroud 222 includes a pressure-side section 232 coupled to blade pressure side 216, and a suction-side section 234 coupled to blade suction side 218. Each pressure-side section 232 includes an interface surface 236 facing generally toward an adjacent suction-side section 234, and each suction-side section 234 includes an interface surface 238 facing generally towards the adjacent pressure-side section 232.

Interface surfaces 236 and 238 are configured to cooperate with each other to form part-span shroud 222 when blades 220 are in rotational operation. For example, in the embodiment shown in FIG. 4, interface surfaces 236 and 238 each have modified cooperating "z" shapes with respective middle portions 240 and 242. When blades 220 are stationary, a gap 244 may generally be defined between at least a portion of the pressure-side interface surface 236 of one blade and the adjacent suction-side interface surface 238 of an adjacent blade. When blades 220 are in rotational operation, blades 220 generally experience a change in twist such that pressure-side middle portion 240 slides along adjacent suction-side middle portion 242, bringing pressure-side interface surface 236 into substantially full contact with suction-side interface surface 238, reducing or eliminating gap 244, and thereby providing vibration damping and structural support to tip portions 210 of blades 220. In the operational state, a leading edge of pressure-side section 232 and a leading edge of suction-side section 234 cooperate to form part-span shroud leading edge 224, and a trailing edge of pressure-side section 232 and a trailing edge of suction-side section 234 cooperate to form part-span shroud trailing edge 226, as shown in FIG. 3. In alternative embodiments, interface surfaces 236 and 238 need not have the described modified "z" shapes, but may have any configuration that allows pressure-side section 232 and suction-side section 234 to cooperate to form part-span shroud 222 when blades 220 are in rotational operation.

Figure 5:
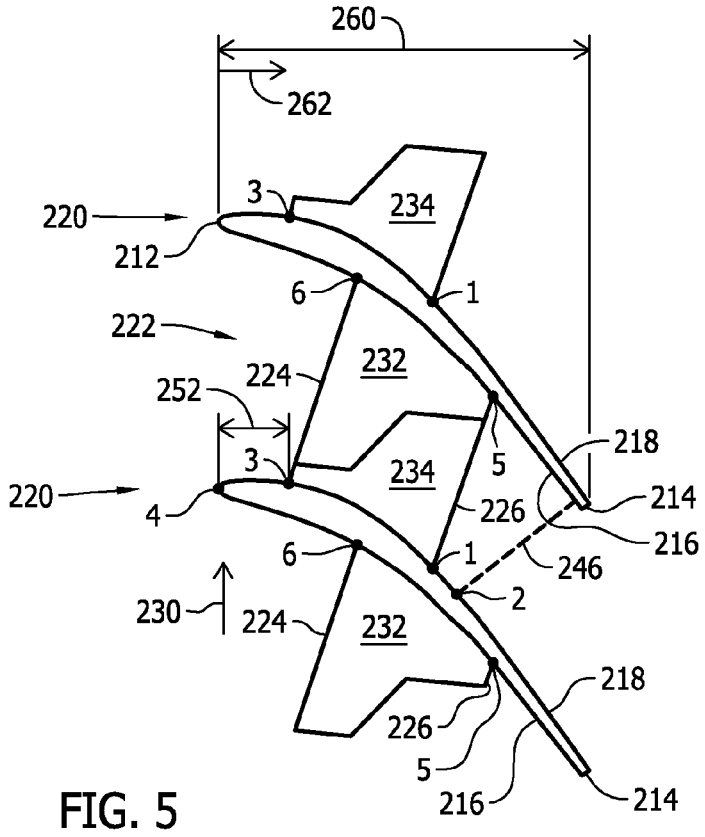
FIG. 5 is a cross-sectional schematic view of the embodiment of the part-span shroud shown in FIG. 4.

A cross-sectional schematic view of the embodiment of part-span shroud 222 shown in FIG. 4, viewed in a radially inward direction from above two adjacent blades 220, is shown in FIG. 5. A direction of rotation 230 of blades 220 is generally indicated by an arrow. A distance between blade leading edge 212 and blade trailing edge 214 in a direction perpendicular to direction of rotation 230 defines an axial chord length 260 of each blade 220. A location of any point on each blade 220 can be defined by its axial distance 262 downstream from blade leading edge 212. A throat 246 of the flow path between the blades 220 is designated by a dotted line.

A geometry of the embodiment shown in FIG. 5 can be described with reference to point 1, point 2, point 3, and point 4 of the suction side 218 of blade 220 and point 5 and point 6 of the pressure side 216. More specifically, part-span shroud trailing edge 226 intersects suction side 218 at point 1, and throat 246 intersects suction side 218 at point 2. Part-span shroud leading edge 224 intersects suction side 218 at point 3, and point 4 is defined at blade leading edge 212. Part-span shroud trailing edge 226 intersects pressure side 216 at point 5, and part-span shroud leading edge 224 intersects pressure side 216 at point 6.

In some embodiments, point 1 is located upstream from point 2, thus facilitating an avoidance of any loss of efficiency due to interference of part-span shroud 222 with throat 246. In addition, in some embodiments, part-span shroud leading edge 224 and part-span shroud trailing edge 226 are not parallel to direction of blade rotation 230. Instead, part-span shroud leading edge 224 asymmetrically intersects pressure side 216 farther downstream than it intersects suction side 218, and part-span shroud trailing edge 226 also asymmetrically intersects pressure side 216 farther downstream than it intersects suction side 218. In other words, point 6 is located downstream from point 3, and point 5 is located downstream from point 1. Thus, despite the positioning of the part-span shroud trailing edge 226 in a relatively upstream location along the suction side 218 of each blade 220 to avoid interference with throat 246, part-span shroud 222 nevertheless facilitates providing structural support to portions of blade 220 closer to blade trailing edge 214.

Additionally, in certain embodiments, point 3 is located downstream from point 4 by a distance 252. This downstream location of point 3 relative to blade leading edge 212 removes an obstacle to incoming hot gas flow at blade leading edge 212. In certain embodiments, a performance improvement is facilitated when distance 252 is greater than or equal to five percent of the axial chord length 260.

Figure 6:
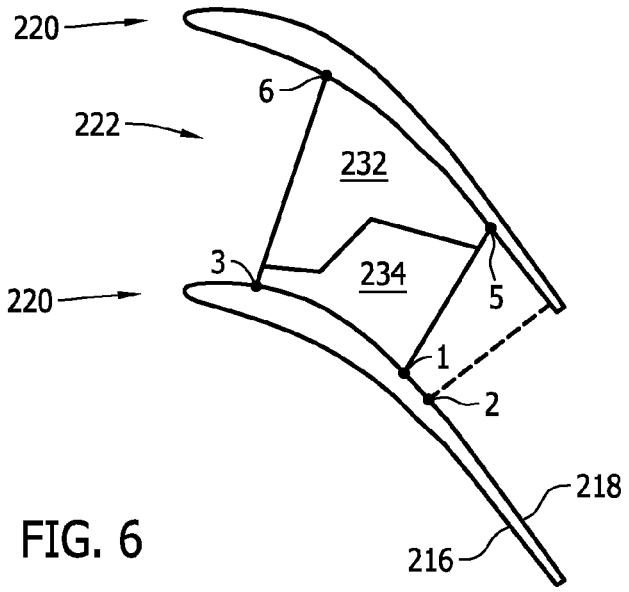
FIG. 6 is a cross-sectional schematic view of another embodiment of a part-span shroud.
Figure 7:
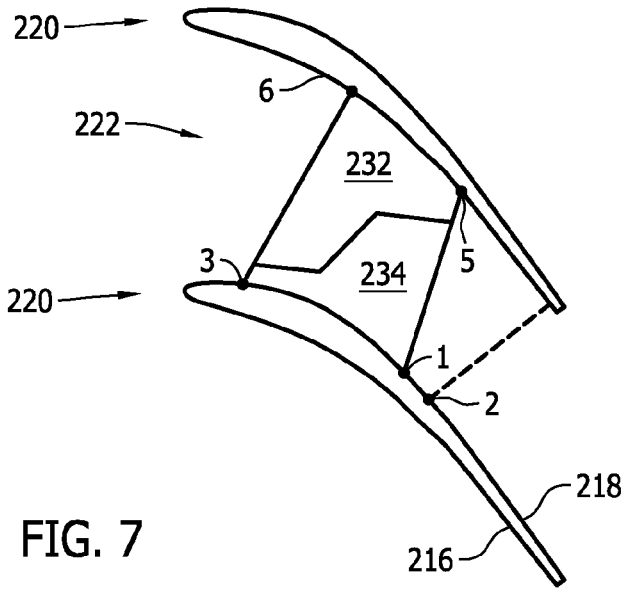
FIG. 7 is a cross-sectional schematic view of yet another embodiment of a part-span shroud.
Figure 8:
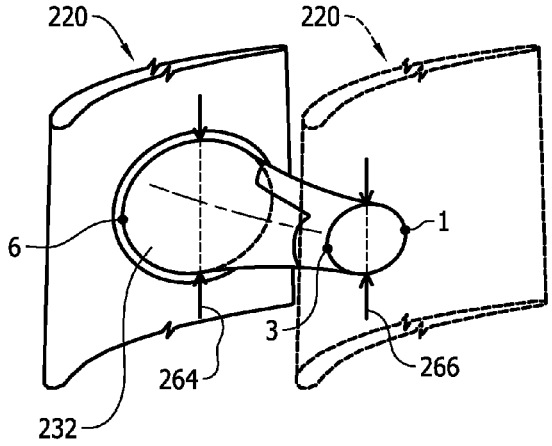
FIG. 8 is a perspective view of still another embodiment of a part-span shroud.

It should be noted that alternative embodiments of part-span shroud 222 may have widely varying geometries. For example, in the embodiment shown in FIG. 6, the axial distance between point 5 and point 6 is greater than the axial distance between point 1 and point 3. As another example, in the embodiment shown in FIG. 7, the axial distance between point 5 and point 6 is less than the axial distance between point 1 and point 3. In alternative embodiments, a distance between part-span shroud leading edge 224 and part-span shroud trailing edge 226 may vary non-continuously along a span of part-span shroud 222. Additionally, a thickness of part-span shroud 222, measured in a direction perpendicular to direction of rotation 230 and to a measurement direction of axial distance 262 (both shown in FIG. 5), may vary in certain embodiments. As an example, in the embodiment shown in FIG. 8, a maximum thickness 264 of pressure-side section 232 is greater than a maximum thickness 266 of suction-side section 234. In each of these alternative embodiments, however, point 1 is located upstream from point 2, point 3 is located downstream from point 4, and point 5 is located downstream from point 1, as described above.

Figure 9:
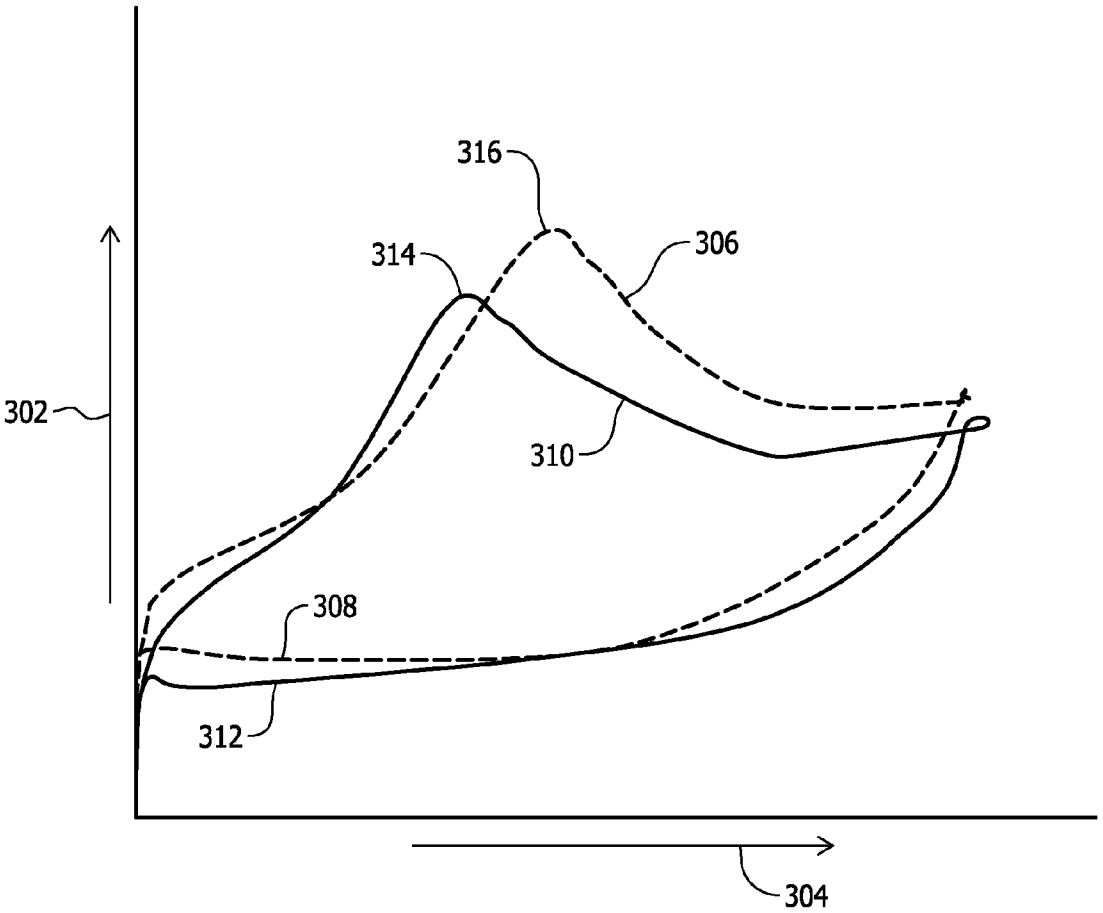
FIG. 9 is a graph of Mach number loading on the blade near an embodiment of the part-span shroud shown in FIG. 5 as a function of position along a chord of the blade of the rotary machine.

A graph of Mach number loading on the blade near part-span shroud 222 as a function of axial distance 262 along blade 220 is shown in FIG. 9. In particular, axis 302 corresponds to increasing Mach number, while axis 304 corresponds to increasing axial distance 262 downstream from blade leading edge 212. Line 306 represents Mach number along suction side 218, and line 308 represents Mach number along pressure side 216, for a conventional prior art part-span shroud. Similarly, line 310 represents Mach number along suction side 218, and line 312 represents Mach number along pressure side 216, for an embodiment of part-span shroud 222. As can be seen, a peak Mach number 314 resulting from the use of part-span shroud 222 is less than a peak Mach number 316 achieved using a conventional prior art part-span shroud. In some embodiments, this decrease in peak Mach number results in a gain in efficiency for a stage of a rotary machine in which blades 220 having part-span shroud 222 are used.

Figure 10:
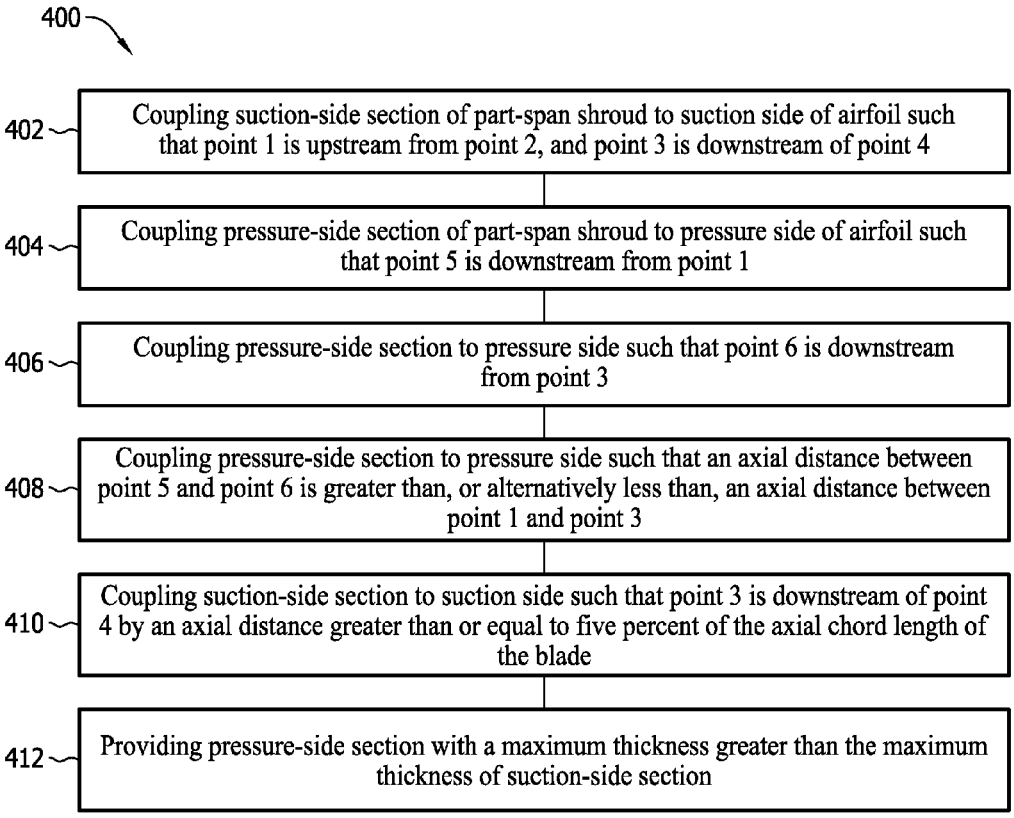
FIG. 10 is a flow chart illustrating an embodiment of a method of manufacturing a blade including a part-span shroud for use with a rotary machine.

An exemplary method 400 of manufacturing a blade including a part-span shroud for a rotary machine is illustrated in FIG. 10. With reference also to FIG. 4 and FIG. 5, exemplary method 400 includes coupling 402 suction-side section 234 of part-span shroud 222 to suction side 218 of airfoil 202 such that point 1, defined where a trailing edge 226 of the suction-side section 234 intersects suction side 218, is upstream from point 2, defined where throat 246 intersects suction side 218 when the rotary machine is in operation, and such that point 3, defined where leading edge 224 of suction-side section 234 intersects suction side 218, is downstream of point 4, defined at blade leading edge 212. Exemplary method 400 also includes coupling 404 pressure-side section 232 to pressure side 216 of airfoil 202 such that point 5, defined where trailing edge 226 of pressure-side section 232 intersects pressure side 216, is downstream from point 1.

Exemplary method 400 also includes coupling 406 pressure-side section 232 to pressure side 216 such that point 6, defined where leading edge 224 of pressure-side section 232 intersects pressure side 216, is downstream from point 3. It further includes coupling 408 pressure-side section to pressure side 216 such that an axial distance between point 5 and point 6 is greater than, or alternatively less than, an axial distance between point 1 and point 3. Additionally, method 400 includes coupling 410 suction-side section 234 to suction side 218 such that point 3 is downstream of point 4 by an axial distance greater than or equal to five percent of axial chord length 260 of blade 220. Exemplary method 400 further includes providing 412 pressure-side section 232 with maximum thickness 264 that is greater than maximum thickness 266 of suction-side section 234.

Exemplary embodiments of a blade having an asymmetric part-span shroud for use with a rotary machine, and of a method of manufacturing such a blade, are described above in detail. The embodiments provide an advantage in shifting the part-span shroud away from the throat of the flow path between adjacent blades and in providing structural support to the blade trailing edge, while reducing an obstruction of the flow at the blade leading edge. The embodiments also facilitate reducing a peak Mach number loading on the blade near the part-span shroud, and accordingly facilitate an increased efficiency of a stage of the rotary machine.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the invention has been described in terms of various specific embodiments, those skilled in the art will recognize that the invention can be practiced with modification within the spirit and scope of the claims. Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

What is claimed is:

1. A method of manufacturing a blade having a part-span shroud for use with a rotary machine, said method comprising:

coupling a suction-side section of the part-span shroud to a suction-side surface of an airfoil of the blade, wherein the suction-side section is positioned such that:

a first point of the airfoil suction-side surface, defined where a trailing edge of the suction-side section intersects the airfoil suction-side surface, is upstream from a second point of the airfoil suction-side surface, defined where a throat intersects the airfoil suction-side surface when the rotary machine is in operation; and a third point of the airfoil suction-side surface, defined where a leading edge of the suction-side section intersects the airfoil suction-side surface, is downstream from a fourth point of the airfoil suction-side surface, defined at a leading edge of the blade, at an axial distance greater than or equal to five percent of an axial chord length of the blade; and coupling a pressure-side section of the part-span shroud to a pressure-side surface of the airfoil, wherein the pressure-side section is positioned such that:

a fifth point of the airfoil pressure-side surface, defined where a trailing edge of the pressure-side section intersects the airfoil pressure-side surface, is downstream from the first point; and a sixth point of the airfoil pressure-side surface, defined where a leading edge of the pressure-side section intersects the airfoil pressure-side surface, is upstream from the first point, wherein the axial chord length of the blade is defined as the distance between the leading edge of the blade and a trailing edge of the blade in a direction perpendicular to a direction of rotation of the blade when the rotary machine is in operation, and wherein the axial distance is defined in the direction of the axial chord length.

2. A method in accordance with claim 1, further comprising coupling the pressure-side section to the airfoil pressure-side surface such that the sixth point of the airfoil pressure-side surface is downstream from the third point.

3. A method in accordance with claim 2, further comprising coupling the pressure-side section to the airfoil pressure-side surface such that an axial distance between the fifth point and the sixth point is one of greater than or less than an axial distance between the first point and the third point.

4. A method in accordance with claim 2, wherein a maximum thickness of the pressure-side section is greater than a maximum thickness of the suction-side section.

5. A method in accordance with claim 1, wherein the suction-side section comprises a suction-side interface surface and the pressure-side section comprises a pressure-side interface surface, said method further comprising configuring the pressure-side interface surface and the suction-side interface surface such that the pressure-side interface surface cooperates with an adjacent blade suction-side interface surface to form the part-span shroud when the rotary machine is in operation.

6. A blade for use with a rotary machine, said blade comprising:

an airfoil comprising a pressure-side surface and an opposite suction-side surface;

a suction-side section of a part-span shroud coupled to said airfoil suction-side surface such that a first point of said airfoil suction-side surface, defined where a trailing edge of said suction-side section intersects said airfoil suction-side surface, is upstream from a second point of said airfoil suction-side surface, defined where a throat intersects said airfoil suction-side surface when the rotary machine is in operation, and such that a third point of said airfoil suction-side surface, defined where a leading edge of said suction-side section intersects said airfoil suction-side surface, is downstream from a fourth point on said airfoil suction-side surface, defined at a leading edge of said blade, at an axial distance greater than or equal to five percent of an axial chord length of the blade; and a pressure-side section of said part-span shroud coupled to said airfoil pressure-side surface such that a fifth point of said airfoil pressure-side surface, defined where a trailing edge of said pressure-side section intersects said airfoil pressure-side surface, is downstream from said first point, and such that a sixth point, defined where a leading edge of said pressure-side section intersects said airfoil pressure-side surface, is upstream from said first point, wherein the axial chord length of said blade is defined as the distance between said leading edge of said blade and a trailing edge of said blade in a direction perpendicular to a direction of rotation of said blade when said rotary machine is in operation, and wherein the axial distance is defined in the direction of the axial chord length.

7. A blade in accordance with claim 6, wherein said pressure-side section is coupled to said airfoil pressure-side surface such that said sixth point is downstream from said third point.

8. A blade in accordance with claim 7, wherein an axial distance between said fifth point and said sixth point is greater than or equal to an axial distance between said first point and said third point.

9. A blade in accordance with claim 7, wherein an axial distance between said fifth point and said sixth point is less than an axial distance between said first point and said third point.

10. A blade in accordance with claim 6, wherein said suction-side section comprises a suction-side interface surface and said pressure-side section comprises a pressure-side interface surface, said pressure-side interface surface configured to cooperate with an adjacent blade suction-side interface surface to form said part-span shroud when the rotary machine is in operation.

11. A blade in accordance with claim 6, wherein a maximum thickness of said pressure-side section is greater than a maximum thickness of said suction-side section.

12. A rotary machine comprising:

at least one rotor wheel coupled to a shaft; and a plurality of blades coupled to said at least one rotor wheel, each of said blades comprising:

an airfoil comprising a pressure-side surface and an opposite suction-side surface;

a suction-side section of a part-span shroud coupled to said airfoil suction-side surface such that a first point of said airfoil suction-side surface, defined where a trailing edge of said suction-side section intersects said airfoil suction-side surface, is upstream from a second point of said airfoil suction-side surface, defined where a throat intersects said airfoil suction-side surface when said rotary machine is in operation, and such that a third point of said airfoil suction-side surface, defined where a leading edge of said suction-side section intersects said airfoil suction-side surface, is downstream from a fourth point on said airfoil suction-side surface, defined at a leading edge of said blade, at an axial distance greater than or equal to five percent of an axial chord length of the blade; and a pressure-side section of said part-span shroud coupled to said airfoil pressure-side surface such that a fifth point of said airfoil pressure-side surface, defined where a trailing edge of said pressure-side section intersects said airfoil pressure-side surface, is downstream from said first point, and such that a sixth point, defined where a leading edge of said pressure-side section intersects said airfoil pressure-side surface, is upstream from said first point, wherein the axial chord length of said each of said blades is defined as the distance between said leading edge of said each of said blades and a trailing edge of said each of said blades in a direction perpendicular to a direction of rotation of said each of said blades when said rotary machine is in operation, and wherein the axial distance is defined in the direction of the axial chord length.

13. A rotary machine in accordance with claim 12, wherein said pressure-side section is coupled to said airfoil pressure-side surface such that said sixth point is downstream from said third point.

14. A rotary machine in accordance with claim 13, wherein an axial distance between said fifth point and said sixth point is greater than or equal to an axial distance between said first point and said third point.

15. A rotary machine in accordance with claim 13, wherein an axial distance between said fifth point and said sixth point is less than an axial distance between said first point and said third point.

16. A rotary machine in accordance with claim 12, wherein said suction-side section comprises a suction-side interface surface and said pressure-side section comprises a pressure-side interface surface, said pressure-side interface surface configured to cooperate with an adjacent blade suction-side interface surface to form said part-span shroud when said rotary machine is in operation.

17. A rotary machine in accordance with claim 12, wherein a maximum thickness of said pressure-side section is greater than a maximum thickness of said suction-side section.

18. A method in accordance with claim 5, wherein configuring the pressure-side interface surface and the suction-side interface surface further comprises configuring the pressure-side interface and the suction-side interface surfaces to define a gap between the pressure-side interface surface and the adjacent blade suction-side interface surface when the rotary machine is not in operation, and to couple to each other in face-to-face contact to form the part-span shroud when the rotary machine is in operation.

19. A blade in accordance with claim 10, wherein said pressure-side interface surface is configured to define a gap between said pressure-side interface surface and said suction-side interface surface of the adjacent blade when the rotary machine is not in operation, and to couple to each other in face-to-face contact to form said part-span shroud when the rotary machine is in operation.

20. A rotary machine in accordance with claim 16, wherein said pressure-side interface surface is configured to define a gap between said pressure-side interface surface and said suction-side interface surface of the adjacent blade when the rotary machine is not in operation, and to couple to each other in face-to-face contact to form said part-span shroud when the rotary machine is in operation.

* * * * *